US009920535B2

(12) United States Patent
Belman et al.

(10) Patent No.: US 9,920,535 B2
(45) Date of Patent: Mar. 20, 2018

(54) DEVICE OF HELPING A VEHICLE TO NEGOTIATE AN OBSTACLE

(71) Applicant: MYD"L", Saint Denis (FR)

(72) Inventors: Pierre Belman, Saint Denis (FR); Frederic Engler, Saint Denis (FR)

(73) Assignee: MYD"L", Saint Denis (FR)

( * ) Notice: Subject to any disclaimer, the term of this patent is extended or adjusted under 35 U.S.C. 154(b) by 0 days.

(21) Appl. No.: 15/304,894

(22) PCT Filed: Apr. 22, 2015

(86) PCT No.: PCT/FR2015/051083

§ 371 (c)(1),
(2) Date: Oct. 18, 2016

(87) PCT Pub. No.: WO2015/162378

PCT Pub. Date: Oct. 29, 2015

(65) Prior Publication Data

US 2017/0183877 A1 Jun. 29, 2017

(30) Foreign Application Priority Data

Apr. 22, 2014 (FR) ..... 14 53600

(51) Int. Cl.
*E04F 11/00* (2006.01)

(52) U.S. Cl.
CPC ..... *E04F 11/002* (2013.01); *E04F 2011/005* (2013.01); *E04F 2011/007* (2013.01)

(58) Field of Classification Search
CPC ..... E04F 11/002; E04F 2011/005; E04F 2011/007
USPC ..... 14/69.5, 71.1; 414/537
See application file for complete search history.

(56) References Cited

U.S. PATENT DOCUMENTS 5,380,144 A * 1/1995 Smith ..... A61G 3/061 14/71.3
5,393,192 A * 2/1995 Hall ..... A61G 3/061 14/69.5
6,598,253 B1 * 7/2003 Allen ..... A61G 3/061 14/69.5
7,052,227 B2 * 5/2006 Navarro ..... B60P 1/431 414/537

(Continued)

OTHER PUBLICATIONS

Abstract of German Patent—DE10255516 dated Jun. 17, 2004, 1 page.

(Continued)

*Primary Examiner* — Raymond W Addie
(74) *Attorney, Agent, or Firm* — Dority & Manning, P.A.

(57) ABSTRACT

A device (1) for helping a wheeled vehicle to negotiate an obstacle, characterized in that it comprises a stationary frame (10) and at least one deployable ramp (2), said ramp having a bottom end intended to come into contact with the ground (3) and an opposite top end mechanically connected to at least one ramp lifting lever that lifts the top end of said ramp over an end-of-extraction-travel portion, said lifting lever being in the form of a foot mounted so as to pivot on the ramp between an inactive flapped-down position and an end position in which said foot at least partially supports the weight of the top end of said ramp, said foot having a lifting function over a travel portion adjacent to the end position and being kept in contact with the ground.

14 Claims, 11 Drawing Sheets

(56) References Cited

U.S. PATENT DOCUMENTS

Figure 1:
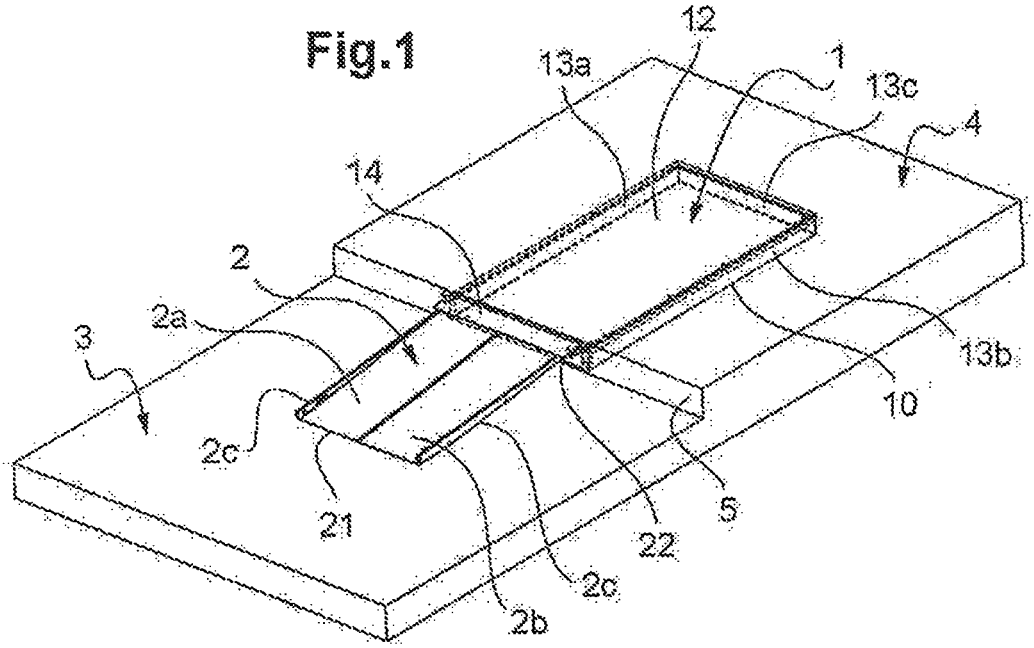

| | | | | |
|---|---|---|---|---|
| 7,228,582 | B1 * | 6/2007 | Jones | B63B 27/143 14/69.5 |
| 7,326,024 | B2 | 2/2008 | Cohn et al. | |
| 7,810,198 | B2 * | 10/2010 | Sahr | A61G 3/06 14/69.5 |
| 2002/0110444 | A1 * | 8/2002 | Navarro | B60P 1/431 414/537 |
| 2006/0133915 | A1 * | 6/2006 | Day | B60P 1/43 414/537 |
| 2009/0106918 | A1 * | 4/2009 | Van Roosmalen | A61G 3/061 14/69.5 |

OTHER PUBLICATIONS

Abstract of French Patent—FR2947224 dated Dec. 31, 2010, 1 page.
International Search Report for PCT/FR2015/051083 dated Sep. 2, 2015, 3 pages.

* cited by examiner 4
3
2a
2
2c
21
14
2b
2c
V
V

DEVICE OF HELPING A VEHICLE TO NEGOTIATE AN OBSTACLE

CROSS REFERENCE TO RELATED APPLICATION

This application is the national stage entry of International Patent Application No. PCT/FR2015/051083 having a filing date of Apr. 22, 2015, which claims priority to and the benefit of French Patent No. 1453600 filed in the French Intellectual Property Office on Apr. 22, 2014, the entire contents of which are incorporated herein by reference.

The present invention relates to a device for assisting a vehicle to negotiate one or more steps or a threshold, in particular for persons with reduced mobility who are moving with the aid of a wheelchair or persons moving a wheeled trolley which is intended for transporting objects.

It is frequently the case that a shop or a business, or an entrance to a residential property, has an access on the street comprising one or more steps.

Such a threshold has a height which is generally from one to several tens of centimeters and constitutes an obstacle which is often insurmountable for a person with reduced mobility or delivery trolleys.

Of course, this problem does not relate only to external access and such steps may also exist even inside these spaces, in particular in old buildings. It is also possible to find these steps as the access to terraces.

One solution for enabling such a step to be overcome by a wheeled vehicle or trolley involves positioning an access ramp.

A significant constraint relating to the positioning of such a ramp is an absence of permanent encroachment on the public highway, pavement and/or road, passage, corridor, et cetera.

This is because, although indispensable for a person of reduced mobility, the level of use thereof remains generally low. It is consequently advantageous to be able to free up the passage when these ramps are not used.

To this end, there are known removable ramp systems which can be retracted inside a chassis which forms a casing which is intended to be installed over the thickness of the step to be negotiated.

In such a device, the ramp is accommodated inside the chassis (or casing) and is deployed in a direction which is substantially normal relative to the step to be negotiated.

Such a device is described, for example, in the document FR 2 947 224, in the name of the Applicant.

A major concern of the Applicant is to ensure discreet integration of its device and to preserve to the greatest possible extent the appearance of the location. To this end, it may be desirable to install a device with an extractable ramp below a floor covering, in particular of the same type as the surrounding floor, or below the existing floor covering.

This is, for example, particularly important for old buildings, historic locations, museums, luxury shops, etcetera.

The device is covered with an additional floor thickness, which thickness may reach a few centimeters in the case of some materials, in particular a marble slab or a stone covering.

The Applicant has noted that, as a result of the design of the device, the retractable ramp is generally deployed at the upper limit of the chassis and arrives at the maximum substantially at the level of an upper surface of the chassis.

The additional floor covering consequently results in the presence of a projection which constitutes an additional obstacle for the vehicle. The Applicant has sought to facilitate the negotiation thereof.

The Applicant found itself confronted with this problem and, rather than abandon the principle of a discreet and aesthetic integration of its device, decided to solve it.

There is consequently a need for an assistance device with a retractable ramp which takes into account these constraints and which enables these disadvantages to be at least partially overcome.

To this end, the present invention proposes a device for assisting the negotiation of an obstacle by a wheeled vehicle, in particular for persons of reduced mobility.

The device is characterized in that it comprises a stationary chassis and at least one ramp which can be deployed in accordance with an extraction path between a retracted position inside the chassis and a deployed position outside the chassis, the ramp having a lower end which is intended to move into abutment against a floor and an opposing upper end, the upper end being mechanically connected to at least one lifting lever for the ramp which can be activated by the movement of the ramp, bringing about a lifting of the upper end of the ramp over an extraction path end portion, the lifting lever being produced in the form of at least one foot which is pivotably mounted on the ramp between an inactive folded position, and a final position in which the foot at least partially supports the weight of the upper end of the ramp, the foot being a lifting member over a path portion adjacent to the final position.

The term adjacent to the final position is intended to be understood to mean a portion of the path located closer to the final deployed position of the foot than the inactive folded position of the foot. In particular, the foot becomes a lifting member from when it comes into contact with the floor. The path portion adjacent to the final position extends from the path portion located between the time when the foot comes into contact with the floor and the time when the foot reaches the final position thereof.

In this manner, by associating the ramp with a lifting lever which is activated at the end of the extraction travel of the ramp, an extraction movement of the ramp, which is generally substantially horizontal, is converted into a movement which has a vertical component which enables the upper end of the ramp to be raised. A single drive movement both enables the ramp to be extracted in a substantially horizontal manner and enables the upper end of the ramp to be raised.

The upper end of the ramp may thus be raised until, if necessary, the upper limit of the chassis has been exceeded and it has moved level with a covering floor, or at least approached it in order to minimize the projection.

The amplitude of the lever movement is determined in accordance with the final height to be achieved.

The use of the lifting lever in the form of a foot which is supported on the floor enables a solid support of the ramp to be ensured. Furthermore, after the ramp has been completely deployed and raised, the lever foot is located in a substantially vertical position which enables optimum support of the ramp and the vehicle which is intended to use it.

According to a preferred embodiment, the device comprises at least one retention connection which is capable of being blocked in translation relative to the chassis by one end and to the foot by an opposite end which is located remote from the pivoting location of the foot, the retention connection ensuring that the foot is deployed and is held in abutment against the lower floor over the extraction path end portion. The retention connection will, for example, be able to be fitted substantially halfway or a third of the way up the foot.

Advantageously, the foot is pivotably mounted counter to at least one resilient return member, of the helical spring type, which tends to return it to the folded position.

The resilient return member thus ensures that the foot is returned to the inactive folded position thereof when the ramp is stored, in particular in response to the unblocking or release of the retention connection.

In a complementary manner, the lifting foot forms a main lifting lever and the device comprises at least one secondary lifting lever which is in the form of at least one inclined connection rod which comprises a first end which is mechanically connected to the upper end of the ramp and a second end which is guided inside the chassis and which is kept at a height which is less than the height of the first end, the connection rod moving, over an extraction path end portion, into abutment with a return component which is mounted in the chassis and which brings about a lifting action of the first end of the connection rod and, consequently, the upper end of the ramp.

The use of an inclined connection rod enables a guiding ramp to be produced which ensures that the upper end of the ramp is raised when the inclined component is forced against the return component.

According to a first construction variant, the return component is a runner which has an inclined contact surface.

According to a second construction variant, the return component is a wheel. In an advantageously complementary manner, the ramp has an extraction path portion which precedes the path end portion which ensures the lifting action, and in which the ramp is capable of resting on the wheel. In this manner, the wheel has a dual support function which facilitates the extraction of the ramp and the return component when interacting with the inclined connection rod.

Advantageously, the first end of the connection rod is pivotably connected to the ramp and in that the second end of the connection rod is pivotably connected to a guiding element. Preferably, the first end of the connection rod is connected to the ramp by means of a double ball joint, and in that the second end of the connection rod is connected to a guiding element by means of a double ball joint. Such connections enable the relative movements, and in particular the change of inclination, between the ramp and the connection rod to be accommodated during the deployment or the retraction.

Advantageously, the connection of the connection rod to the ramp substantially coincides with an articulation axis for pivoting the lifting foot. The transmission and the absorption of the forces by the foot are thus optimized.

Preferably, the secondary lifting lever is activated before the foot which forms the lifting lever. The lifting lever connection rod thus enables the lifting of the ramp to be started before the foot, which forms the main lifting lever, is activated.

According to a first construction variant, the device comprises at least one handle which is intended to enable manual driving of the ramp.

According to a second alternative or additional construction variant, the device comprises at least one drive motor which is mounted on at least one drive carriage which is connected to a connection rod of the ramp and which is associated with a rack in the chassis. If necessary, the inclined connection rod which forms the secondary lever may advantageously be connected to the drive carriage which acts as a means for guiding the connection rod.

As indicated above, a single drive movement both enables the ramp to be extracted substantially horizontally and enables the upper end of the ramp to be raised.

In the event of manual driving, the traction movement which enables the ramp to be extracted will also enable the upper end to be raised at the end of the deployment path.

In the case of motorized driving, the device enables a single motor to be used, which has significant advantages in terms of cost, weight and control of the device.

Advantageously, the device comprises a retention drawer member which supports at least the guide rails of the ramp.

This is because, as a result of the presence of the additional floor thickness above the device, the chassis is no longer readily accessible directly from the top of the device. The use of an extractable drawer member at the front face enables the inner elements of the device to be readily removed, enables the necessary operations to be carried out (replacement of components, adjustments, etcetera) before replacing the drawer member.

Figure 2:
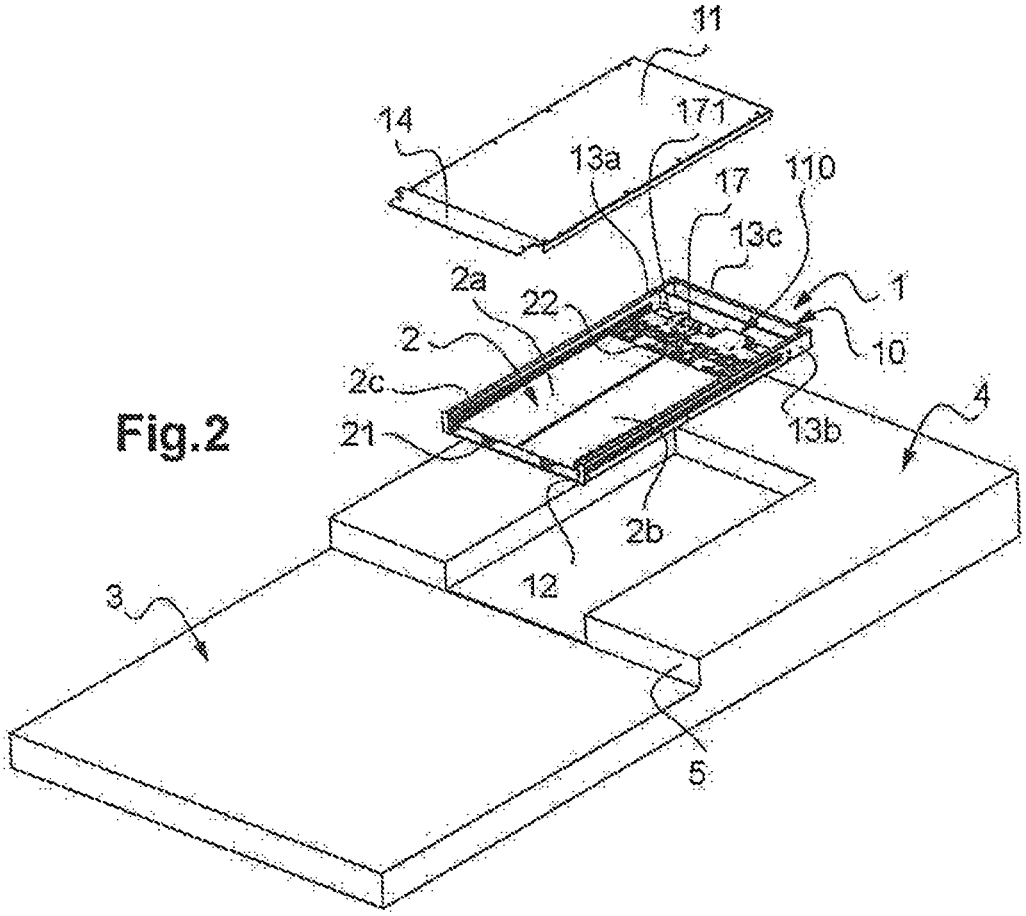
Figure 3:
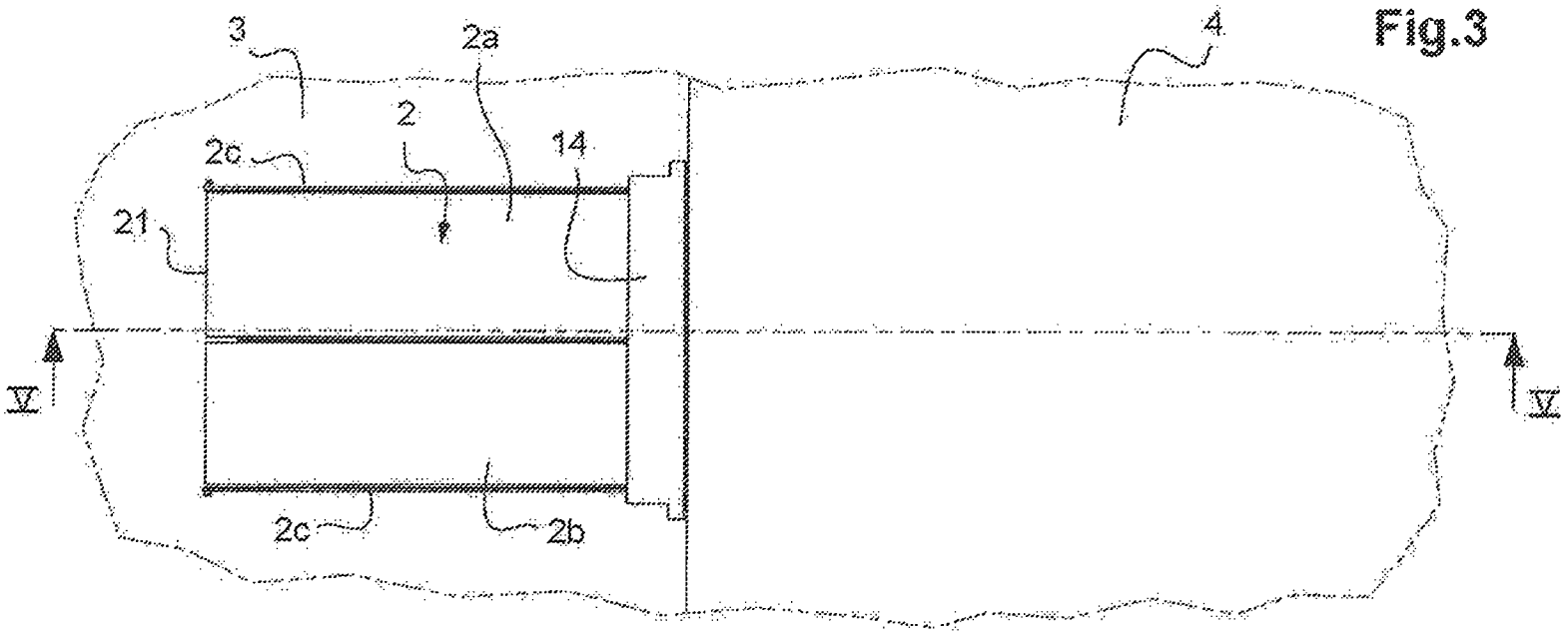
Figure 4A:
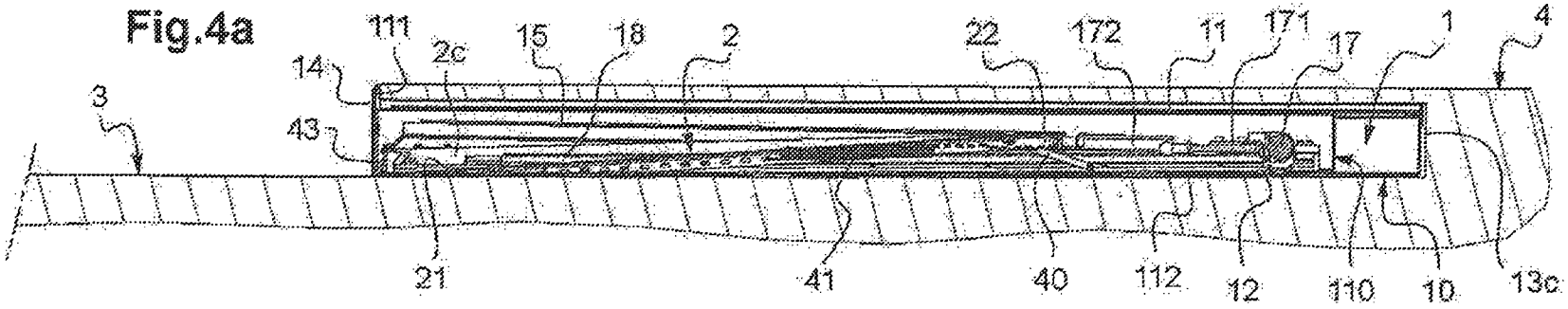
Figure 4B:
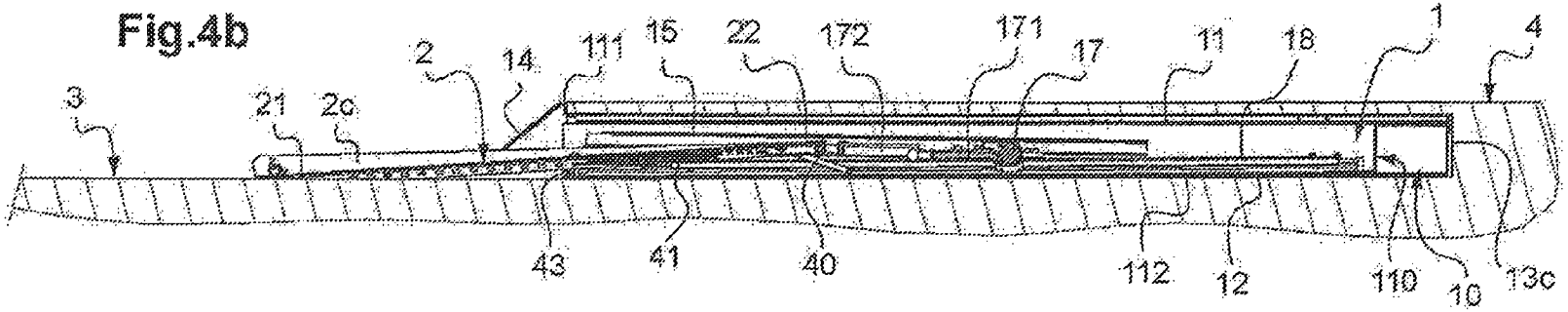
Figure 4C:
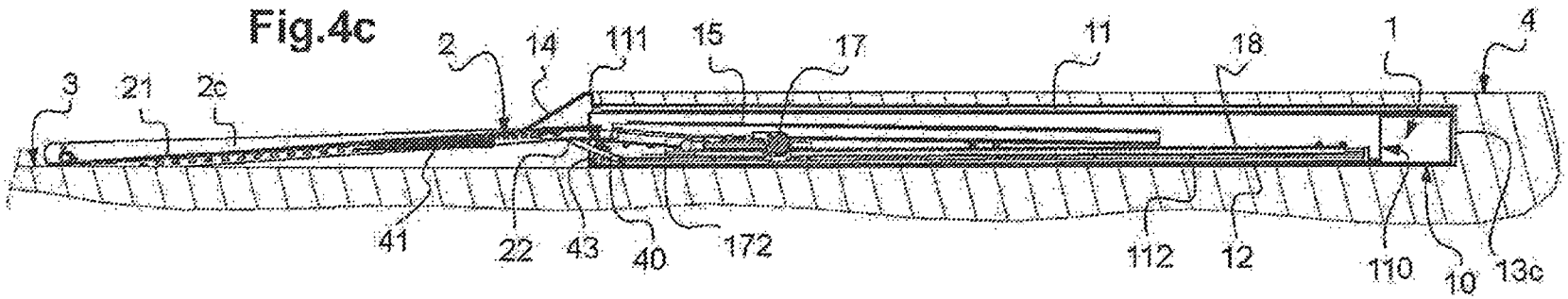
Figure 4D:
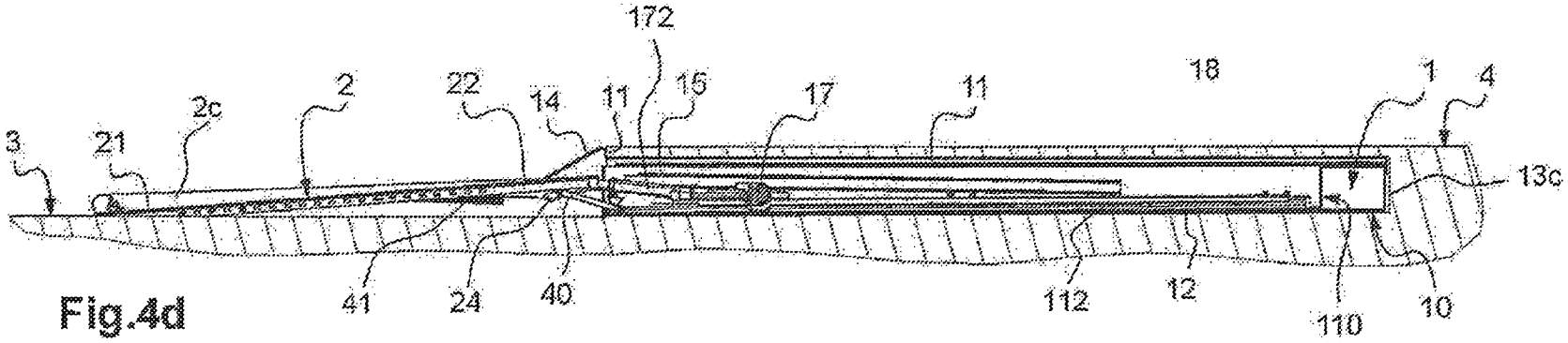
Figure 4E:
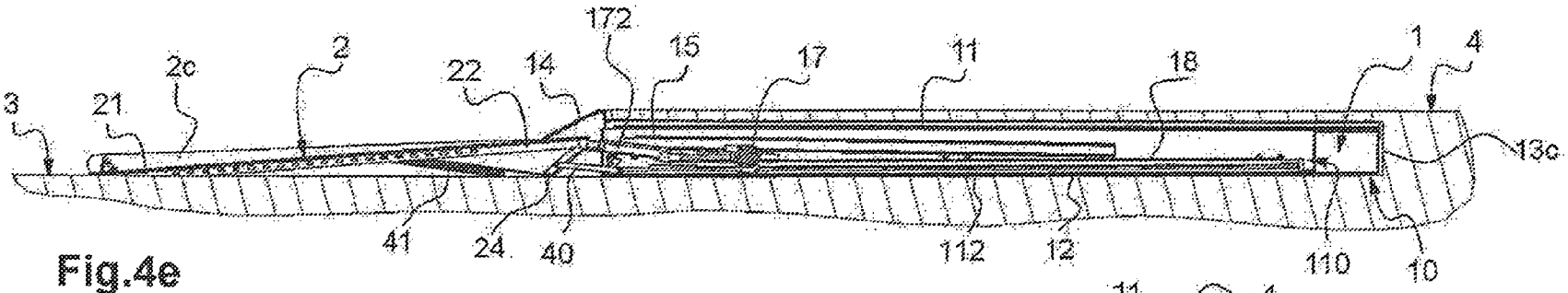
Figure 4F:
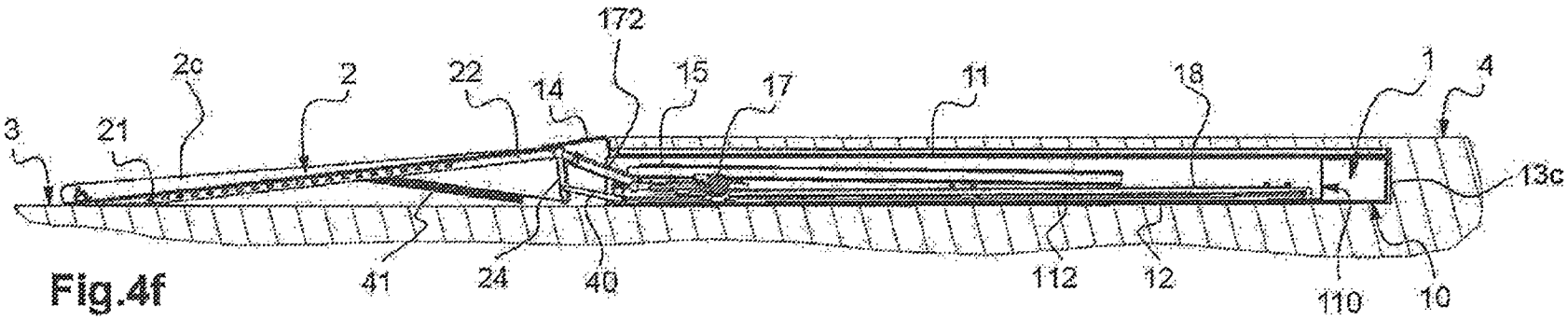
Figure 7:
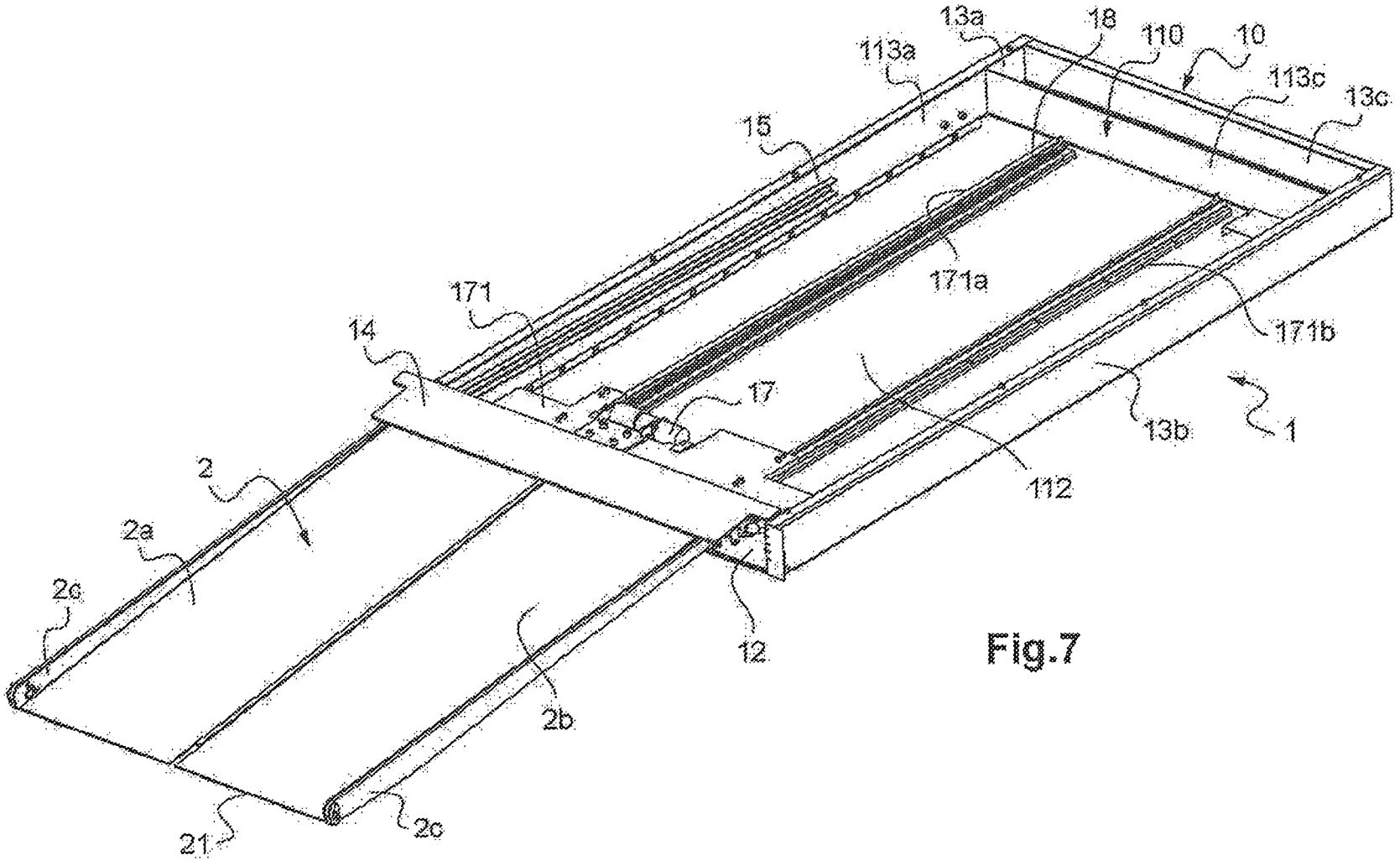
Figure 8:
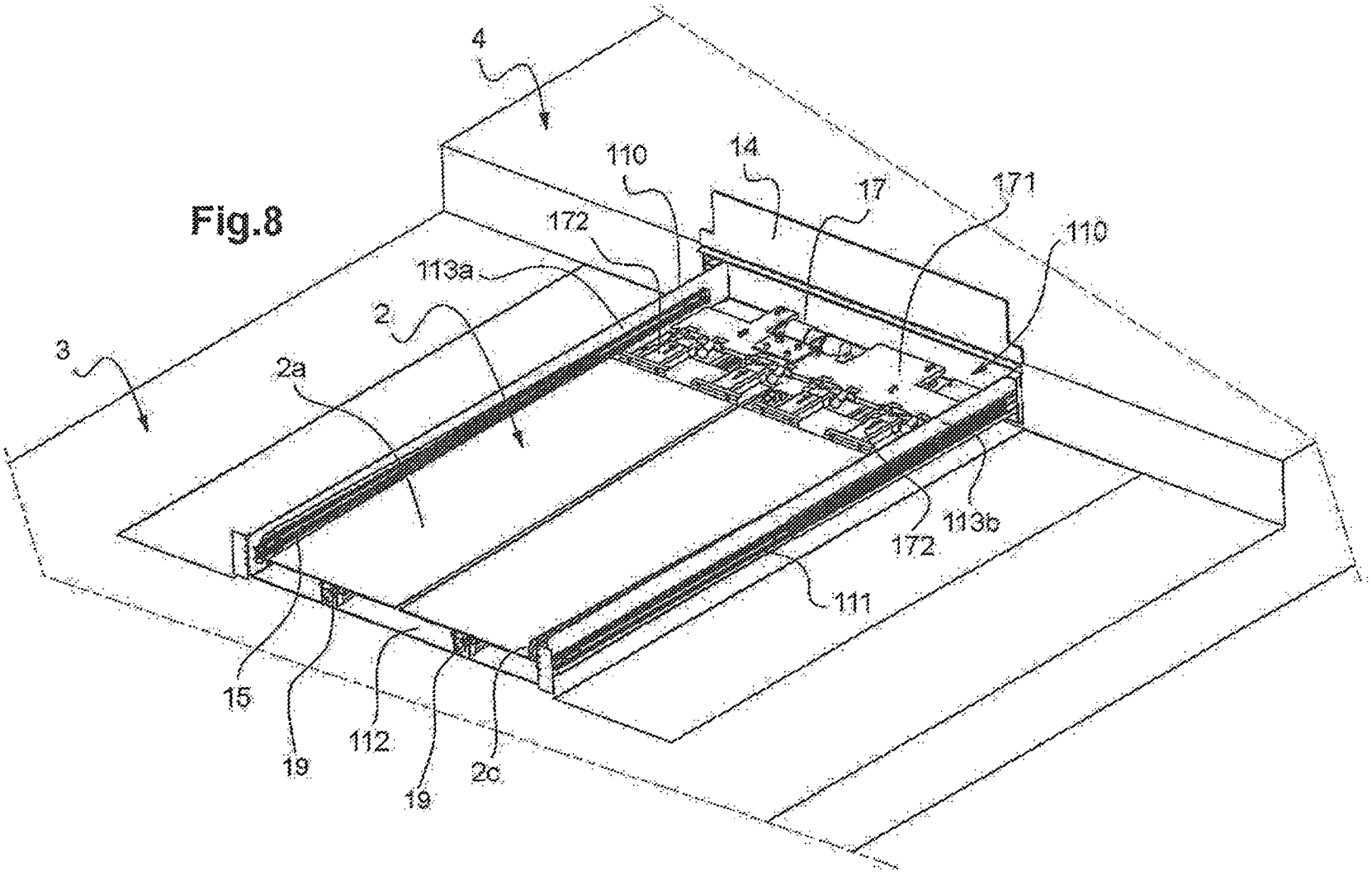

The use of the invention will be better understood with reference to the detailed description which is set out below with reference to the appended drawings, in which:

FIG. 1 is a schematic illustration of a device according to the invention which is embedded in a step, in a deployed configuration, FIG. 2 is an exploded view of the device of FIG. 1, in the retracted configuration, FIG. 3 is a top view of the device of FIG. 1, FIGS. 4*a* to 4*f* are schematic longitudinally sectioned side views along the axis V-V of FIG. 3 showing the device at different stages of deployment/storage of the ramp, FIG. 4*a* corresponding to an initial configuration of the device, the ramp being stored inside it, FIG. 4*b* corresponding to an initial deployment phase of the ramp before activation of the lever mechanisms, FIG. 4*c* corresponds to the activation time of a first lever mechanism, that is to say, an inclined connection rod, FIG. 4*d* corresponds to an intermediate phase after activation of the first lever mechanism and before activation of a second lever mechanism, FIG. 4*e* corresponds to the time of activation of the second lever mechanism, FIG. 4*f* corresponds to the device in the final deployed configuration with the ramp in the raised position, FIGS. 5*a* to 5*f* are enlarged views of the zone A of the corresponding FIGS. 4*a* to 4*f*, FIG. 6 is an illustration of the inner side of the device of FIG. 1, in a retracted configuration, FIG. 7 is an illustration of the inner side of the device of FIG. 1, in a deployed configuration, FIG. 8 is an illustration of the device of FIG. 1 in the maintenance configuration.

An assistance device 1, one embodiment of which is illustrated in FIGS. 1 to 8, is intended to enable the deployment of a retractable ramp 2 between a lower floor or level 3 and an upper floor or level 4 whose delimitation forms one or more steps 5 as a result of a difference in level between these two surfaces.

The device 1 is intended to ensure more particularly the positioning of a retractable ramp which has an inclination of less than 20%, or less than 15, 10 or 5% in accordance with the regulatory or environmental constraints.

As set out above, this device 1 substantially, but without being limited thereto, relates to access to shops or businesses from the street which are often capable of having one or more steps.

In such a case, the lower floor 3 is constituted by a path or a pavement whilst the upper floor or level 4 is constituted by the floor of the business or the shop.

The device 1 is intended to be inserted or embedded in the upper floor 4, in front of the lower floor 3 in the region of the access to be negotiated.

The device 1 comprises a chassis 10 which forms a casing inside which a deployable ramp 2 is accommodated (FIGS. 2, 4*a*, 5*a*, 6). In the operational state (FIGS. 1, 3, 4*f*, 5*f*, 7) or deployed state, the ramp 2 leaves the chassis 10 and moves into abutment relative to the step 5. The ramp 2 can thus be retracted.

In order to retain the appearance of the location and to ensure discreet integration, the device 1 is intended to be covered by a portion of the upper level 4 (FIGS. 4*a*-4*f*, 5*a*-5*f*, 8; in FIG. 1, the chassis 10 is shown in the transparent state with broken lines). As indicated above, covering the device 1 brings about the formation of a projection with respect to the chassis 10.

The chassis 10 has a generally parallelepipedal shape whose dimensions are adapted to the height of the step 5, to the width of the access and to the dimensions of the vehicle. For example, the chassis 10 may have a height in the order of from 10 to 50 centimeters which enables insertion in the majority of levels and floors, such as a slab of concrete, brick, or the like. The chassis 10 is further provided with an upper wall 11 which forms a cover. The chassis 10 also comprises a base wall 12, lateral walls 13*a*, 13*b* and a rear wall 13*c*.

Furthermore, the device 1 comprises a front face 14 which is movably mounted so as to open in the chassis 10 a passage for extraction of the ramp 2. To this end, the front face 14 is in the form of a pivoting shutter which is articulated along an upper edge of the chassis 10. More specifically, the front face 14 is articulated to a front terminal wing 111 of the cover 11. The wing 111 is perpendicular to the cover 11 and extends substantially over the thickness of the upper floor 4 which covers the device 1.

The extractable ramp 2 has a slender, lower front end 21 which is intended to move into abutment against the lower floor or level 3 and an opposing upper rear end 22. The ramp 2 can be deployed in accordance with an extraction path (arrow FIG. 4*a*) between a position retracted inside the chassis 10 (FIGS. 4*a*, 5*a*) and a position deployed outside the chassis 10 (FIGS. 4*f*, 5*f*).

The ramp 2 has an upper travel surface. The ramp 2 is also provided with lateral guide wheels 2*c*. More particularly, the ramp has a mechanically welded structure.

According to the specific embodiment illustrated, the ramp 2 is produced in the form of two semi-ramps 2*a*, 2*b*. In the case of such a ramp 2 which is produced from a plurality of ramp elements, the ramp elements may be extracted independently from each other or simultaneously, using common or separate drive means. A ramp 2 which is produced from a plurality of elements also enables any camber of the lower floor to be better taken into account.

In an advantageously complementary manner, and as can be seen most particularly in FIG. 8, the inner elements of the chassis 10, which will be described below are installed on a maintenance drawer member 110 which can be extracted via the front face 14 of the device 1. This drawer member 110 enables easy access to the inner elements of the device 1, in particular when maintenance operations are necessary.

The drawer member 110 comprises a base 112, a rear wall 113*c* and two lateral walls 113*a*, 113*b*. The drawer member 110 is open at the front face in order to enable the ramp 2 to be removed during normal operation.

The drawer member 110 is slidingly mounted on the chassis 10 using a system of telescopic rails 114 which are fixed in the lateral walls 113*a*, 113*b* of the drawer member 110 and the corresponding lateral walls 13*a*, 13*b* of the chassis 10. The drawer member 110 is associated with a removable blocking means (not visible) which is accessible via the front face of the device 1 and which enables it to be fixed in position when it is inside the chassis 10.

The assembly of the system for driving and guiding the ramp 2, which will be described below, is mounted on the drawer member 110.

In the absence of the drawer member 110, the elements which are mounted in the base wall 112, rear wall 113*c* and lateral walls 113*a*, 113*b* of the drawer member will be mounted directly in the corresponding base wall 12, rear wall 13*c* and lateral walls 13*a*, 13*b* of the chassis 10.

The deployment of the ramp 2 may be carried out manually, for example, by means of handles, or as in the embodiment illustrated, by a motor 17.

More specifically, the motor 17 is fixed to a drive carriage 171 which is connected to the ramp 2 and drives a toothed wheel (not visible) which cooperates in terms of engagement with a rack 18 which is fixed in the base wall 112 of the drawer member 110.

The drive carriage 171 is guided in translation along two longitudinal and parallel base rails 171*a*, 171*b* which cooperate with corresponding bearings (not visible) which are installed below the drive carriage 171. The base rails 171*a*, 171*b* are fixed in the base wall 112 of the drawer member 110, for example, using screws.

The base rails 171*a*, 171*b* may also serve to support the ramp 2 when it is at least partially retracted inside the chassis 10.

The drive carriage 171 is mechanically connected to the ramp 2 using an assembly of tubular connection rods 172 which have ends which are ball-jointed at the front to the ramp and at the rear to the drive carriage 171.

Each connection rod 172 has a hollow body which is produced from components of welded metal sheets. The connection rod 172 in particular has a lower wall 172*a* which is extended in an upward direction by an extension 172*c* which extends substantially as far as the upper end 22 of the ramp and whose use will be described below.

In this instance, each semi-ramp is associated with two connection rods 172 which have two ends which each carry the male portion of two ball joints 173. The female portion of the ball joints 173 is fixed to the semi-ramp which is arranged opposite or to the drive carriage in accordance with the ball joint 173 in question.

The ball-jointed connection rods 172 enable degrees of freedom to be conferred on the ramp, in terms of play and clearance whilst ensuring the translation movement of the ramp 2. Alternatively, pivoting rings with play can be used.

By way of example, a clearance of approximately more or less 25 mm is provided.

Furthermore, the connection rods 172 can advantageously be adjusted in terms of length (telescopic connection rods, for example) in order to enable adjustment with respect to the environment of installation and to take into account production tolerances.

The extractable ramp 2 is movably mounted inside the chassis 10 along corresponding longitudinal lateral rails 15 which at least partially guide the deployment and arrangement thereof inside the chassis 10. The lateral rails 15 also contribute to the support of the ramp 2.

The guide rails 15 of the ramp 2 are fixed in the lateral walls 113*a*, 113*b* of the drawer member 110. Each rail extends over most of the length of the drawer member 110 and has a profile which cooperates with lateral bearings (not visible) of the ramp 2. Each rail 15 will be able in particular to have a profile which is C-shaped (example illustrated), L-shaped or U-shaped, for example.

Each rail 15 has an open front end which enables the ramp to be released from the rail 15. Each rail 15 also has a rear end which will advantageously be able to be closed and thus constitute a stop at the end of the storage path.

Figure 5A:
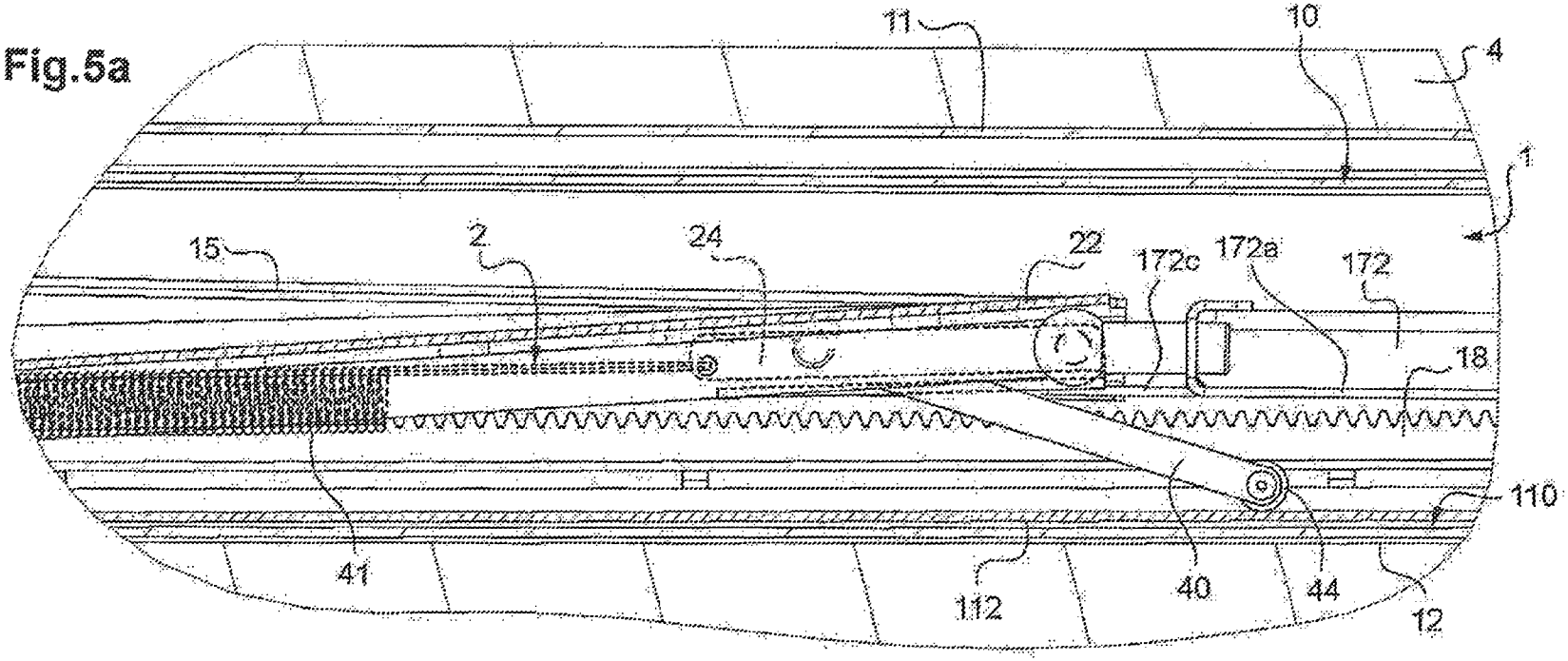
Figure 5B:
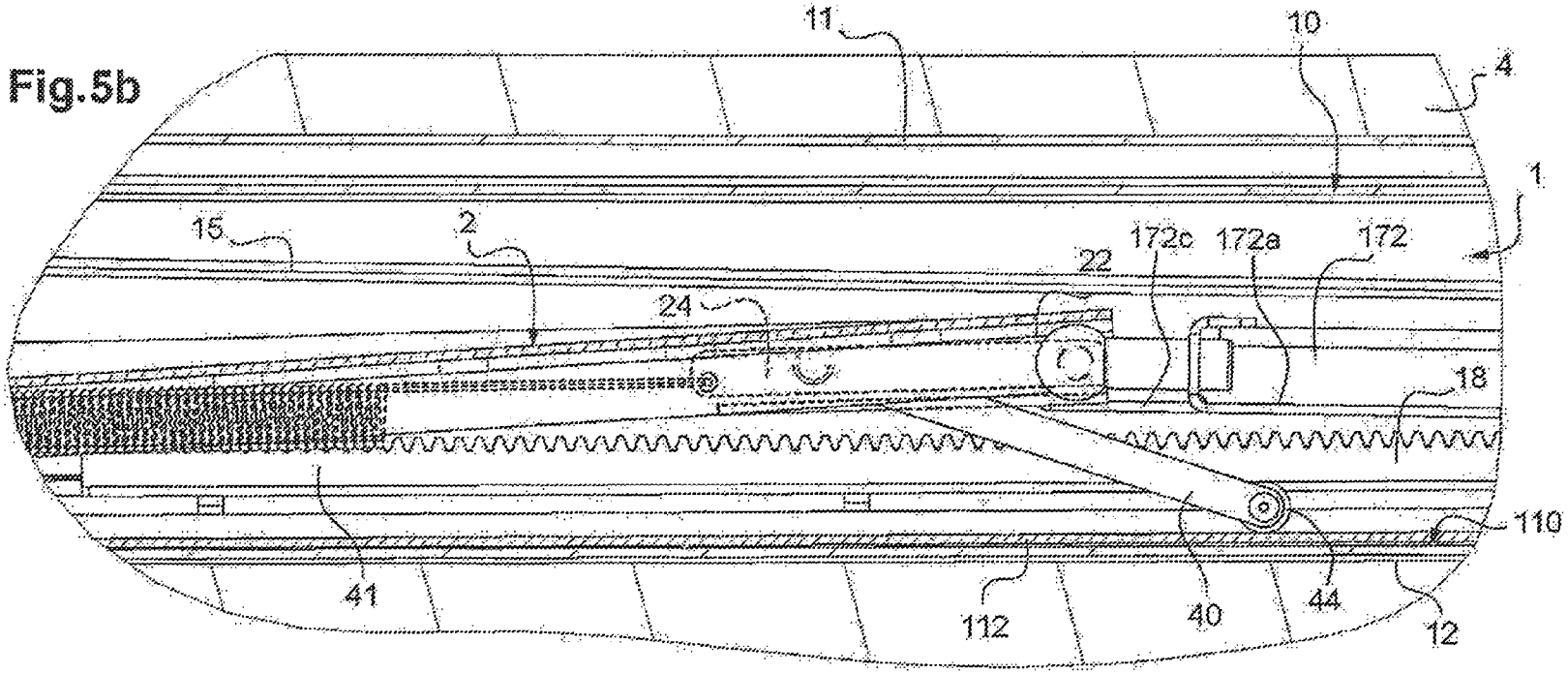

FIGS. 4*a*, 4*b*, and corresponding FIGS. 5*a*, 5*b* show an initial phase for deployment of the ramp 2. The ramp 2 is deployed in a substantially rectilinear manner. The lower end 21 of the ramp 2 slides or travels over the lower level 3 whilst the upper end 21 moves in translation along the guide rails 15 substantially halfway up the chassis 10.

At the end of the deployment path, the upper end 22 of the ramp 2 is raised so that it arrives as close as possible to the surface of the upper floor 4.

This phase is illustrated in FIGS. 4*c* to 4*f* and in the corresponding FIGS. 5*c* to 5*f*.

In order to raise the upper end 22 of the ramp 2, it is freed from the lateral rails 15. A system of lifting levers is activated over a deployment path end portion.

In this instance, the device 1 illustrated uses two complementary lifting lever mechanisms. However, each mechanism may optionally be used independently.

A first lever mechanism comprises a foot 24 which is pivotably mounted on the ramp 2, close to the upper end 22, between an inactive folded position and a deployed position in which the foot is held in abutment against the lower level 3.

The foot 24, being in abutment against the lower floor 3 before the end of its path (FIGS. 4*e*, 5*e*), constitutes a lever which drives the raising of the opposite end of the foot 24 and consequently the upper end 22 of the ramp 2.

The foot 24 is deployed and held in abutment by a retention connection 40 which is held in the chassis 10 and which is capable of being blocked in terms of translation in the chassis 10 via one of the ends thereof. The foot 24 is also mounted counter to a resilient return means, for example, a spring 41 which is in particular helical and which tends to return it into the folded position. In this instance, the spring 41 operates under traction.

The spring 41 is attached by means of a first end to the foot 24 and by a second opposite end to the ramp 2.

More specifically, the spring 41 is attached to the foot 24 in the region of an end of the foot 41 opposite the pivoting location of the foot 24 on the ramp 2.

The second end of the spring 41 is attached to the ramp 2 downstream of the pivoting location of the foot 24 on the ramp 2 toward the lower end 21 of the ramp 2.

The retention connection 40 is in the form of an arm which has a first end which is attached in a pivoting manner to the foot 24, remote from the pivoting location thereof on the ramp 2, and which has a second end which moves on the base 112 of the drawer member 110 of the chassis 10. The second end is provided with a wheel 44.

The retention function is carried out by means of a stop 43 which is arranged at the front of the chassis 10.

The stop 43 comprises a rim of sheet metal. The stop 43 is mounted on the base wall 112 of the drawer member 110. The stop 43 ensures the blocking in terms of translation of the retention connection 40 and consequently enables the foot 24 to be deployed and held in abutment against the lower level over the extraction path end portion.

The first lever mechanism operates as follows.

During a first extraction phase of the ramp 2 (FIGS. 4*a*, 4*b*, 4*c* and FIGS. 5*a*, 5*b*, 5*c*) in a substantially horizontal direction, the foot 24 is held folded against a lower surface of the ramp 2 by means of the spring 41 thereof. The retention connection 40 is pulled by the movement of the ramp 2 and moves along the base 112 until the second end thereof abuts the stop 43 (FIG. 4*d*, FIG. 5*d*). The upper end 22 of the ramp is substantially extracted at the level of the guide rail 15 as in the initial case.

At the end of this first extraction phase, the retention connection 40 of the foot 24 is therefore blocked in abutment and can no longer follow the ramp 2 in a forward direction. Any subsequent extraction movement of the ramp 2 (manually or by the motor 17) brings about the pivoting of the foot 24 (FIGS. 4*d*, 5*d*). The foot 24 then comes into contact with the lower level 3 (FIGS. 4*e*, 5*e*).

By continuing the extraction movement, the foot 24 is in abutment against the lower level 3 and forces the upper end 22 of the ramp 2 to be raised.

The end 22 of the ramp 2 is raised until the foot 24 is substantially perpendicular to the lower level 3 (FIGS. 4*f*, 5*f*) and the ramp 2, which constitutes the final position of the foot 24. A stop (not visible) ensures the stoppage of the pivoting of the foot 24. The extraction is stopped in a concomitant manner, for example, by a corresponding stop means (electronic stoppage of the motor 17 by determining the distance covered, for example, using a revolution counter or resolver).

The amplitude of the lifting of the upper end 22 is dependent in particular on the length of the foot 24 and its articulation location (pivoting) on the ramp 2. Advantageously, the length of the foot 24 can be adjusted. Such an adjustment will also enable cambers and irregularities of the lower level 3 to be taken into account, where applicable.

In order to limit the friction of the foot 24 against the lower level 3 during its deployment, the foot 24 will be able to be provided with a sliding runner or a terminal wheel.

The ramp 2 may comprise a plurality of feet 24 which are distributed over the width of the ramp. Each semi-ramp 2*a*, 2*b* is in this instance provided with two lateral feet 24.

The use of feet 24 which are supported on the floor ensures a solid support of the ramp 2 once it has been deployed. Furthermore, at the end of deployment, the foot 24 is located in a substantially vertical position which enables optimum support of the ramp 2 and the vehicle which is intended to use it.

Advantageously, the pivot axis of the foot 24 coincides with an attachment location of the connection rod 172 to the upper end 22 of the ramp 2. Such a configuration enables the recovery and the transmission of forces, the stability of the ramp and the reduction in weight of the structure to be further improved.

When the ramp 2 is stored, this mechanism follows the following reverse steps. The return of the ramp 2 to the inner side of the chassis 10 brings about the return of the foot 24 to the folded position thereof under the action of the spring 41. The retention connection 40 is held against the stop 43 thereof until the foot 24 reaches the inactive folded position thereof then the retention connection 40 follows the ramp 2 toward the rear of the chassis 10.

The folding of the foot 24 also enables the upper end 22 of the ramp 2 to be lowered by means of gravitational force.

The ramp 2 is reengaged in the support and guide rails 15 and returned (manually or by the motor 17) inside the chassis 10.

According to a construction variant, the retention connection is produced in the form of a strap or a cord which is fixed in a wall of the chassis 10, in particular the rear wall 113*c* of the drawer member 110. In order to prevent a free release of the retention connection inside the chassis 10, the retention connection can be associated with a reel which ensures that it is automatically wound up as the retention connection is relaxed.

A second lifting lever mechanism is produced by the inclined connection rod 172. This is because the connection rod 172 has a first upper end which is connected to the ramp 2 and a second lower end which is mechanically connected to the carriage 171 and held at a height which is less than the height of the first end.

More specifically, the second end of the inclined connection rod 172 is held substantially fixed in terms of elevation relative to the chassis 10.

The inclined connection rod 172 is intended, on the extraction path end portion, to move into abutment against a return component which is mounted in the chassis 10 and which brings about the lifting of the first end of the inclined connection rod and consequently the upper end 22 of the ramp.

The abutment of the connection rod 172 against the return component is carried out by means of a contact surface which is formed by the lower wall 172*a* and the extension 172*c* of the connection rod 172.

More specifically, the inclined connection rod 172 constitutes a lever when it moves into abutment against a wheel 19 which is fixed in the chassis 10 close to the front face for extraction of the ramp 2.

In this manner, the connection rod 172 has a dual function, that is to say, a function for driving the ramp 2 and a function for lifting the ramp on the relevant path end portion.

If necessary, before the lever is activated, the wheel 19 may be used to facilitate the extraction of the ramp 2. The wheel 19 thus also has a dual function, that is to say, a function for supporting the ramp 2 during a first extraction portion of the ramp then a function as a lifting lever on the relevant path end portion.

This system operates as follows.

During a first extraction phase of the ramp 2 (FIGS. 4*a*-4*b* and FIGS. 5*a*, 5*b*), in a substantially horizontal direction, the drive carriage 171 and the connection rod 172 follow a substantially rectilinear trajectory, parallel with the extraction trajectory of the ramp 2.

At the end of the first extraction phase, the connection rod 172 comes into contact against the wheel 19 (FIGS. 4*c*, 5*c*) which then acts as a return component. The contact of the connection rod 172 with the wheel 19 is carried out firstly by means of the extension 172*c* then by means of the lower wall 172*a*.

The end of the connection rod 172 which is connected to the drive carriage 171 being fixed in terms of elevation with respect to the chassis 10, any subsequent extraction movement (manually or by the motor 17) forces the connection rod 172 against the wheel 19 and brings about the increase of the inclination thereof (FIGS. 4*d*, 4*e*, 4*f* and 5*d*, 5*e*, 5*f*). This becomes evident with a relative lifting of the opposing end thereof, and consequently the upper end 22 of the ramp 2.

The amplitude of the lifting is determined by the total length of the connection rod 172 and the maximum inclination thereof.

After the desired height has been reached, the ramp is fixed in position (motor 17 stopped and blocked, blockage of the first mechanism by the foot 24 where applicable).

When the ramp 2 is stored, this second mechanism follows the following reverse steps.

The return of the ramp 2 toward the inner side of the chassis 10 brings about a backward movement of the connection rod 172 which is no longer forced horizontally against the wheel 19, but only vertically by means of gravitational force.

Under the action of the weight of the ramp 2, the inclination of the connection rod 172 decreases and the second end 22 of the ramp 2 is lowered. The ramp 2 is reengaged in the guide rails 15 thereof and returned (manually or by the motor 17) inside the chassis 10.

By this or these lifting lever mechanism(s) which is/are activated at the end of the extraction path by the ramp 2 being associated with the ramp 2, an extraction movement of the ramp which is initially substantially horizontal is converted into a movement which has a vertical component which enables the upper end of the ramp 2 to be raised.

The different mechanisms of the lever may be configured to be activated simultaneously, that is to say, over a path end portion which is substantially identical. Alternatively, the main lever mechanism may be activated before the secondary lever mechanism or vice versa. Advantageously, the secondary lever mechanism starts the lifting of the ramp.

Figure 5C:
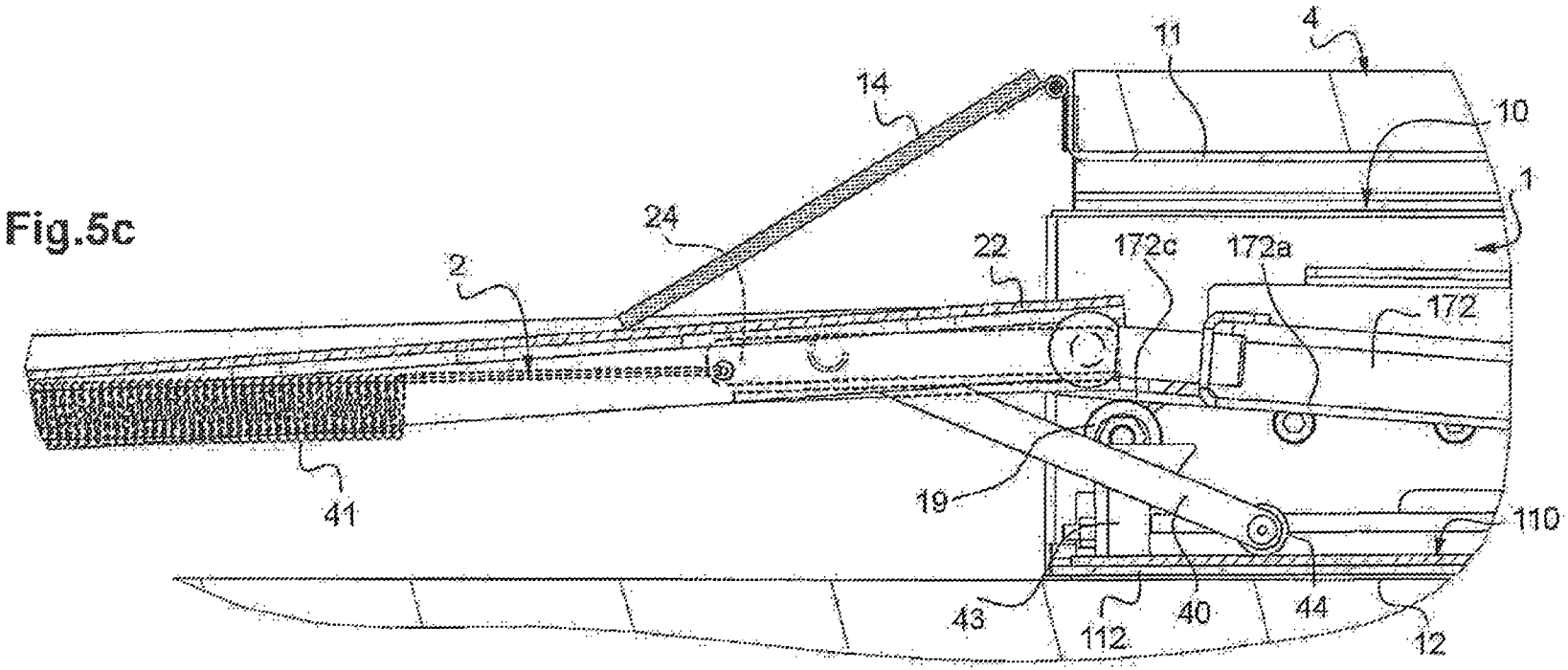
Figure 5D:
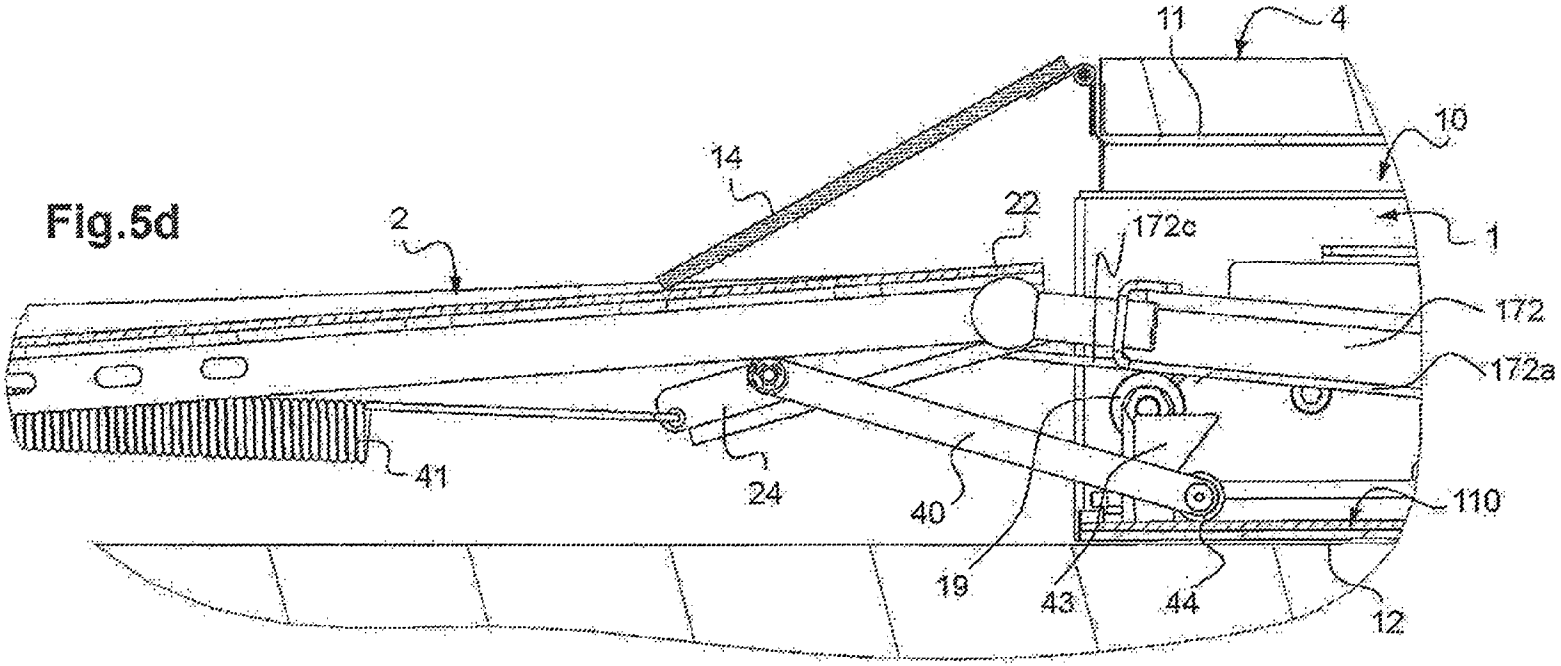
Figure 5E:
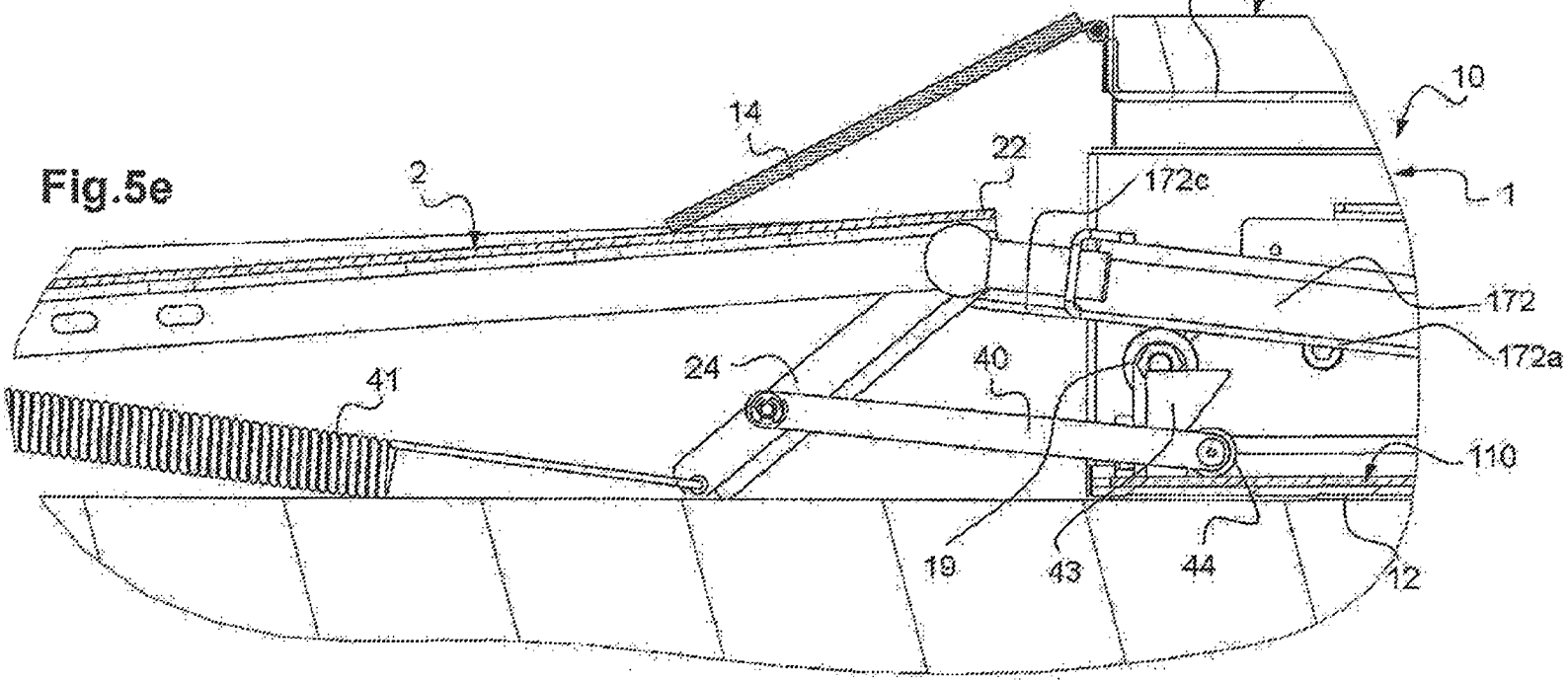
Figure 5F:
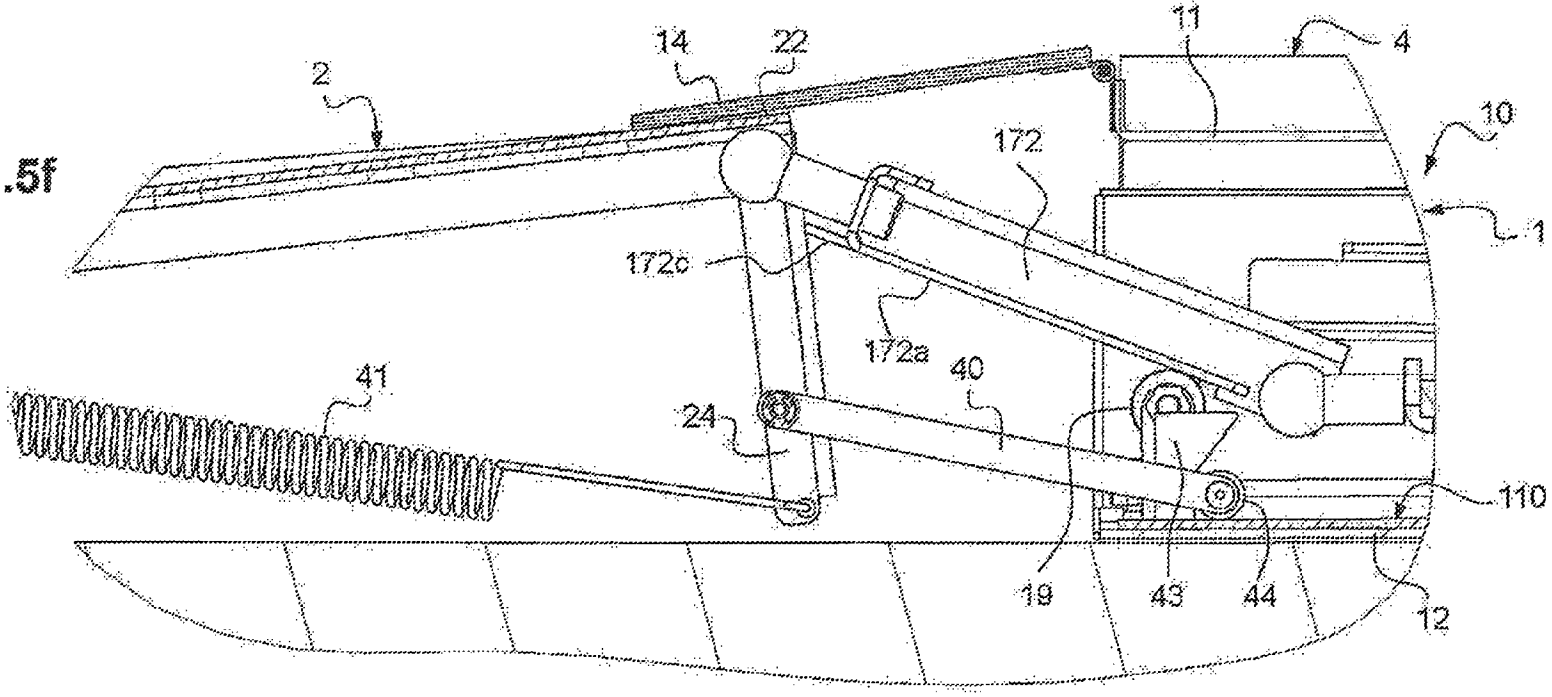
Figure 6:
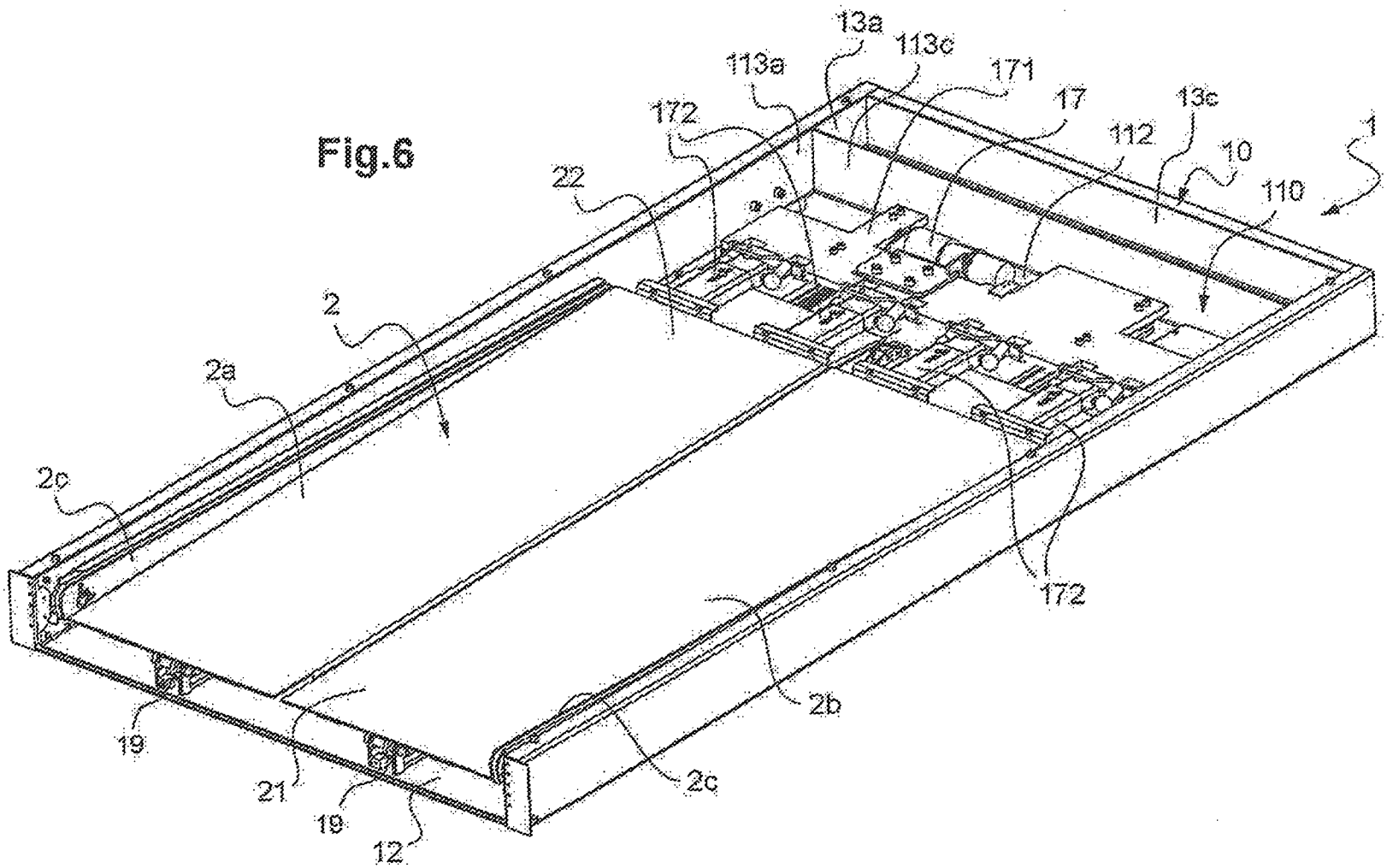

According to the embodiment illustrated in the Figures, the main lever mechanism (foot 24) is activated (FIGS. 4*e*, 5*e*) after the secondary lever mechanism (connection rod 172) (FIGS. 4*c*, 5*c*).

The ramp 2 then has a first neutral extraction phase (FIGS. 4*a*, 4*b*, 5*a*, 5*b*), a lifting start phase (FIGS. 4*c*, 4*d*, 5*c*, 5*d*) in which only the secondary lever mechanism is active, and a full lifting phase (FIGS. 4*e*, 4*f*, 5*e*, 5*f*) in which the main lever mechanism is also active.

A single drive movement both enables the ramp 2 to be extracted in a substantially horizontal manner and enables the upper end 22 of the ramp 2 to be raised. In the case of motorized driving, this advantageously enables the use of a single motor 17 for these two extraction and storage phases. In the case of manual driving, this advantageously enables a single continuous traction or thrust force to be applied without the operator having to change grip.

The upper end 22 of the ramp 2 is thus raised relative to the normal extraction height thereof (substantially the height of the guide rails 15 in this instance) until, where applicable, exceeding the upper limit of the chassis 10 and becoming level with the upper level or floor 4, or at least approaching it in order to minimize the projection.

Furthermore, when it is extracted, the ramp 2 pushes back the shutter 14 which pivots about the axis thereof and moves substantially in continuation of the travel surface of the ramp. The shutter 14 thus enables the residual space remaining between the ramp 2 and the upper floor 4 to be filled.

Although the invention has been described with specific embodiments, it is self-evident that it is in no way limited thereto and that it comprises all the technical equivalents of the means described and their combinations if they are included within the scope of the invention.

The invention claimed is:

1. A device for assisting a wheeled vehicle to negotiate an obstacle, in particular for a person with reduced mobility, characterized in that it comprises a stationary chassis and at least one ramp which can be deployed in accordance with an extraction path between a retracted position inside the chassis and a deployed position outside the chassis, the ramp having a lower end which is intended to move into abutment against a floor and an opposing upper end, the upper end being mechanically connected to at least one lifting lever for the ramp which can be activated by the movement of the ramp, bringing about a lifting of the upper end of the ramp over an extraction path end portion, the lifting lever being produced in the form of at least one foot which is pivotably mounted on the ramp between an inactive folded position, and a final position in which the foot at least partially supports the weight of the upper end of the ramp, the foot being a lifting member over a path portion adjacent to the final position is held in abutment against the floor.

2. The device as claimed in claim 1, characterized in that it comprises at least one retention connection which is capable of being blocked relative to the chassis by one end and to the foot by an opposite end which is located remote from the pivoting location of the foot, the retention connection ensuring that the foot is deployed and is held in abutment against the floor over the extraction path end portion.

3. The device as claimed in claim 1, characterized in that the foot is pivotably mounted counter to at least one resilient return member which tends to return it to the folded position.

4. The device as claimed in claim 1, characterized in that it comprises at least one secondary lifting lever which is in the form of at least one inclined connection rod which comprises a first end which is mechanically connected to the upper end of the ramp and a second end which is guided inside the chassis and which is kept at a height which is less than the height of the first end, the connection rod moving, over an extraction path end portion, into abutment with a return component which is mounted in the chassis and which brings about a lifting action of the first end of the connection rod and, consequently, the upper end of the ramp.

5. The device as claimed in claim 4, characterized in that the return component is a runner which has an inclined contact surface.

6. The device as claimed in claim 4, characterized in that the return component is a wheel (19).

7. The device as claimed in claim 6, characterized in that the ramp has an extraction path portion which precedes the path end portion which ensures the lifting action and in which the ramp is capable of resting on the wheel.

8. The device as claimed in claim 4, characterized in that the first end of the connection rod is pivotably connected to the ramp and in that the second end of the connection rod is pivotably connected to a guiding element.

9. The device as claimed in claim 4, characterized in that the first end of the connection rod is connected to the ramp by means of a double ball joint, and in that the second end of the connection rod is connected to a guiding element by means of a double ball joint.

10. The device as claimed in claim 4, characterized in that the connection of the connection rod to the ramp substantially coincides with an articulation axis for pivoting the lifting foot.

11. The device as claimed in claim 4, characterized in that the secondary lifting lever is activated before the foot which forms the lifting lever.

12. The device as claimed in claim 1, characterized in that it comprises at least one handle which is intended to enable manual driving of the ramp.

13. The device as claimed in claim 1, characterized in that it comprises at least one drive motor which is mounted on at least one drive carriage which is connected to a connection rod of the ramp and is associated with a rack in the chassis (10).

14. The device as claimed in claim 1, characterized in that it comprises a retention drawer member which supports at least the guide rails of the ramp.

* * * * *